US005462489A

United States Patent [19]

Kan et al.

[11] Patent Number: 5,462,489

[45] Date of Patent: Oct. 31, 1995

[54] DRIVE SHAFT FOR AUTOMOTIVE VEHICLE WATER PUMP

[75] Inventors: Yoshio Kan; Takeshi Nakamura; Yukihiro Akabane, all of Kanagawa, Japan

[73] Assignee: NSK Ltd., Tokyo, Japan

[21] Appl. No.: 240,396

[22] Filed: May 10, 1994

Related U.S. Application Data

[63] Continuation of Ser. No. 978,087, Nov. 17, 1992, abandoned.

[30] Foreign Application Priority Data

Nov. 20, 1991 [JP] Japan ..... 3-102819 U

[51] Int. Cl.[6] ..... F01P 11/00

[52] U.S. Cl. ..... 464/179; 417/362; 415/168.2; 415/216.1

[58] Field of Search ..... 464/179, 185; 415/216.1, 218.1, 229, 168.1, 168.2; 417/362

[56] References Cited

U.S. PATENT DOCUMENTS

| | | | |
|---|---|---|---|
| 1,291,388 | 11/1919 | Bright et al. | 464/179 X |
| 2,090,162 | 8/1937 | Tighe | 415/216.1 |
| 2,304,259 | 12/1942 | Karrer | 415/216.1 X |
| 2,775,208 | 12/1956 | Mueller | 415/168.2 |
| 4,380,416 | 4/1983 | Menager | 415/168.2 X |
| 4,737,073 | 4/1988 | Grayden | 415/216.1 |
| 4,817,586 | 4/1989 | Wampler | 415/216.1 X |
| 5,071,316 | 12/1991 | Diem et al. | 417/362 X |
| 5,125,795 | 6/1992 | Suzuki et al. | 417/362 X |
| 5,154,576 | 10/1992 | Dorski et al. | 417/362 X |

FOREIGN PATENT DOCUMENTS

| | | | |
|---|---|---|---|
| 0072712 | 4/1983 | Japan | 464/185 |

*Primary Examiner*—John J. Calvert

*Attorney, Agent, or Firm*—Evenson, McKeown, Edwards & Lenahan

[57] ABSTRACT

A drive shaft for an automotive vehicle water pump has an outer race with plural outer raceways formed in an inner peripheral wall thereof, a shaft member disposed for rotation relative to the outer race and defining a like plural number of inner raceways formed in an outer peripheral wall of the shaft member in radial registration with the corresponding outer raceways, and a multiplicity of rolling elements arranged between the inner raceways and the corresponding outer raceways, respectively. The shaft member comprises a large-diameter bearing portion with the plural inner raceways formed in an outer peripheral wall thereof, a small-diameter impeller shaft portion extending from one end of the large-diameter bearing portion, a small-diameter pulley shaft portion, and a continuously-connecting portion extending between an opposite end of the large-diameter bearing portion and a proximal end of the small-diameter pulley shaft portion. The continuously-connecting portion presents a curved peripheral surface with circular arcs in tangential directions of which an outer peripheral wall of the small-diameter pulley portion extends.

3 Claims, 2 Drawing Sheets

DRIVE SHAFT FOR AUTOMOTIVE VEHICLE WATER PUMP

This application is a continuation of U.S. application Ser. No. 07/978,087 filed Nov. 17, 1992 now abandoned.

BACKGROUND OF THE INVENTION

1) Field of the Invention

This invention relates to a drive shaft for an automotive vehicle water pump. The drive shaft is employed to rotate an impeller of the water pump for recirculating coolant for an engine of an automotive vehicle.

2) Description of the Related Art

A water pump is used to recirculate coolant through a cylinder block of a water-cooled engine in an automotive vehicle. The water pump is equipped with a drive shaft, which has a driven pulley on an end portion thereof and an impeller on an opposite end portion thereof. The impeller is positioned within a coolant passage. The drive shaft is driven by a belt mounted on a drive pulley, which is fixed on an end portion of a crankshaft of the engine, and the driven pulley. As a consequence, the impeller is rotated by the drive shaft to recirculate the coolant.

Reference is first had to FIG. 4 which is a side view of a bearing unit with a drive shaft member assembled therein. It is to be noted that a quarter of the bearing unit has been cut off to show the internal structure. Plural (two in the figure) rows of inner raceways 3,3 are formed in an outer peripheral wall of a large-diameter bearing portion 2 which is provided at an intermediate part of the drive shaft member designated at numeral 1. A like plural number (i.e., two in the figure) of outer raceways 5,5 are formed in an inner peripheral wall of an outer race 4 in radial registration with the respective inner raceways 3,3. Plural ball bearings 6,6 are arranged as rolling elements between the inner raceways 3,3 and the corresponding outer raceways 5,5, respectively, so that the drive shaft member 1 is rotatably supported inside the outer race 4. The outer race 4 is fixed on an unillustrated engine cylinder block.

At opposite end portions of the drive shaft member 1, a small-diameter pulley shaft portion 7 and a small-diameter impeller shaft portion 8 are provided in continuation with proximal end faces of the large-diameter bearing portion 2 so that the small-diameter pulley and impeller shaft portions 7,8 extend coaxially with the large-diameter bearing portion 2. A driven pulley (not shown), on which the belt driven by the drive pulley is mounted, can be fixed on the small-diameter pulley shaft portion 7 (i.e., the right-hand, small-diameter portion as viewed in FIG. 4), while an impeller (not shown) adapted to produce a flow of coolant through the coolant passage can be secured on the small-diameter impeller shaft portion 8 (i.e., the left-hand, small-diameter portion as viewed in FIG. 4).

In the drive shaft member 1, each of the small-diameter shaft portions 7,8 and the large-diameter bearing portion 2 are continuously connected via a continuously-connecting portion which presents a circular-arc outer peripheral surface as depicted in FIG. 5, so that the outer peripheral surfaces of the small-diameter shaft portions 7,8 extend in continuation with the circular-arc outer peripheral surface of the continuously-connecting portion. This continuously-connecting portion is formed in the following manner. First, lathe turning is applied by a lathe or the like to an outer peripheral wall of the drive shaft member 1, whereby a chamfered peripheral edge portion 9 and a first circular arc portion 10 are formed with their outer peripheral surfaces extending continuously from a peripheral edge of the proximal end of the large-diameter bearing portion 2.

At the time right after the formation of the first circular arc portion 10, the outer diameter of the small-diameter pulley shaft portion 7 is still greater than a desired value as indicated by a two-dot chain line a in the same figure. An outer peripheral wall of the small-diameter pulley shaft portion 7 is therefore subjected to grinding after heat treatment, so that the outer peripheral wall is removed as thick as $\delta$ to reduce the outer diameter of the small-diameter pulley shaft portion 7 to the desired value. By such grinding, a second circular arc portion 11 is formed at a radius of curvature, which is determined by the profile of a grinding stone employed in the grinding work, at the continuously-connecting portion between the first circular arc portion 10 and the outer peripheral surface of the small-diameter pulley shaft portion 7, whereby a connecting peripheral outer edge 12 remains as a boundary.

As a result, the large-diameter bearing portion 2 and the small-diameter pulley shaft portion 7 are continuously connected via the chamfered portion 9 and the first and second circular arc portions 10,11.

The conventional drive shaft member for an automotive vehicle water pump, in which the large-diameter bearing portion 2 and the small-diameter pulley shaft portion 7 are continuously connected in such a form as described above, may not exhibit sufficient strength in some instances. A driven pulley is fixed on the small-diameter pulley shaft portion 7 and a drive belt is mounted on the driven pulley. Substantially large tension of the belt is therefore applied to the driven pulley. In addition, a cooling fan for an engine is also mounted on the small-diameter pulley shaft portion 7. As a consequence, significant bending load is applied to the drive shaft member 1.

Under such significant bending load, substantial stress is applied to the first and second circular arc portions 10,11. There is hence the potential danger that, in the course of use of the drive shaft member 1 over a long time, a crack may occur in at least one of the circular arc portions 10,11 and the drive shaft member 1 may be broken there.

Carburizing may be applied to the surface of the drive shaft member 1 especially to improve the durability of the rolling bearing unit. When such carburizing is applied, intergranular oxide layers may be formed in black scales in the surface of the first circular arc portion 10 so that the strength of the drive shaft member 1 may be reduced considerably there. This makes the drive shaft member 1 more susceptible to breakage.

SUMMARY OF THE INVENTION

An object of this invention is to provide a breakage-resistant drive shaft for an automotive vehicle water pump by reducing the concentration of stress on the continuously-connecting portion between the large-diameter bearing portion 2 and the small-diameter pulley shaft portion 7.

In one aspect of the present invention, there is thus provided a drive shaft for an automotive vehicle water pump, said drive shaft having an outer race with plural outer raceways formed in an inner peripheral wall thereof, a shaft member disposed for rotation relative to the outer race and defining a like plural number of inner raceways formed in an outer peripheral wall of the shaft member in radial registration with the corresponding outer raceways, and a multiplicity of rolling elements arranged between the inner raceways and the corresponding outer raceways, respectively. The shaft member comprises:

a large-diameter bearing portion with the plural inner raceways formed in an outer peripheral wall thereof;

a small-diameter impeller shaft portion extending from one end of the large-diameter bearing portion;

a small-diameter pulley shaft portion; and a continuously-connecting portion extending between an opposite end of the large-diameter bearing portion and a proximal end of the small-diameter pulley shaft portion, said continuously-connecting portion presenting a curved peripheral surface with circular arcs in tangential directions of which an outer peripheral wall of the small-diameter pulley portion extends.

In the drive shaft of this invention having the construction as described above, the curved surface portion via which the large-diameter portion and the small-diameter pulley shaft portion are continuously connected to each other continues smoothly with the small-diameter pulley shaft portion. As a result, even when bending load is applied to the small-diameter pulley shaft portion, localized excessive stress is no longer applied to the continuously-connecting portion between the small-diameter pulley shaft portion and the large-diameter bearing portion so that the drive shaft is made resistant to breakage. In particular, black scales can be removed from the surface of the curved surface portion by conducting the surface grinding of the curved surface portion and the small-diameter pulley shaft portion after their heat treatment. This makes it possible to avoid the above-described strength reduction due to the formation of intergranular oxide layers, so that the prevention of breakage of the drive shaft can be ensured further. A water pump with the drive shaft of the present invention assembled therein can therefore exhibit improved durability and reliability.

BRIEF DESCRIPTION OF THE DRAWINGS

The above and other objects, features and advantages of the present invention will become apparent from the following description and the appended claims, taken in conjunction with the accompanying drawings, in which:

DETAILED DESCRIPTION OF THE INVENTION AND PREFERRED EMBODIMENTS

Figure 1:
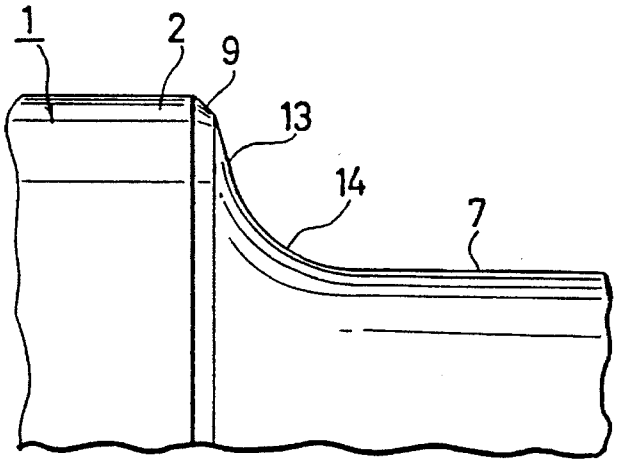
FIG. 1 is an enlarged, fragmentary side view of a drive shaft according to a first embodiment of the present invention, in which associated outer race and rolling members are omitted.

The drive shaft according to the first embodiment of this invention will now be described with reference to FIG. 1. A chamfered portion 9 is formed at a peripheral outer edge of an end of a large-diameter bearing portion 2. Formed in continuation with a peripheral outer edge of the chamfered portion 9, said peripheral outer edge being on the side of a small-diameter pulley shaft portion 7, is an inclined surface portion 13 having a conical convex outer surface whose inclination is more acute than the peripheral surface of the chamfered portion 9. An outer peripheral edge of the inclined surface portion 13, said outer peripheral edge being on the side of the small-diameter pulley shaft portion 7, and a proximal, i.e., inner peripheral edge of the small-diameter pulley shaft portion 7 are continuously connected together via a curved surface portion 14 which presents a circular arc in cross-section.

To smoothly and continuously connect both peripheral edges of the curved surface portion 14 with the proximal peripheral edges of the inclined surface portion 13 and small-diameter pulley shaft portion 7, respectively, the inclined surface portion 13 and the small-diameter pulley shaft portion 7 extend in continuation with and in tangential directions relative to the outer peripheral surface of the curved surface portion 14. These inclined surface portion 13 and small-diameter pulley shaft portion 7 can be formed by grinding the outer peripheral walls of the inclined surface portion 13, curved surface portion 14 and small-diameter pulley shaft portion 7 with a single piece of a grinding stone, which rotates about an axis of rotation extending in parallel with the drive shaft member 1, while rotating the drive shaft member 1.

In the drive shaft of this invention having the construction as described above, the curved surface via which the outer peripheral surface of the large-diameter bearing portion 2 and that of the small-diameter pulley shaft portion 7 extend continuously includes the curved surface portion 14 whose outer peripheral surface extends in a tangential direction relative to the outer peripheral surface of the small-diameter pulley shaft portion 7. The outer peripheral surface of the curved surface portion 14 and that of the small-diameter pulley shaft portion 7 therefore smoothly continue so that, even when bending load is applied to the small-diameter pulley shaft portion 7, no excessive stress is exerted on the connecting portion between the small-diameter pulley shaft portion 7 and the large-diameter bearing portion 2. As a consequence, the drive shaft member 1 is resistant to breakage.

Figure 2:
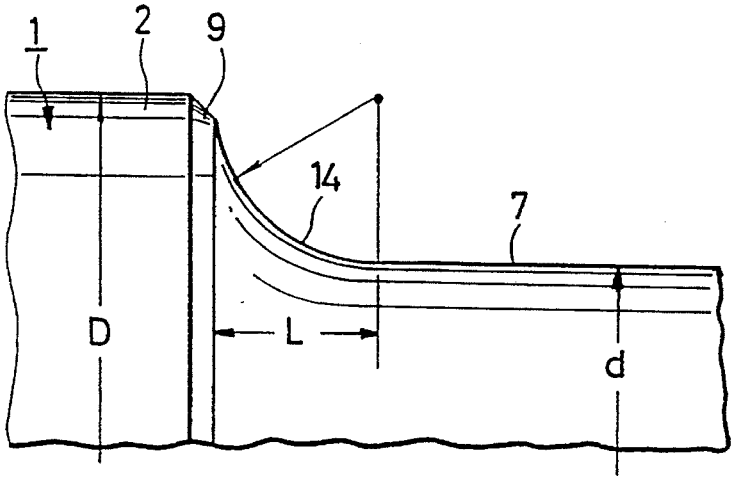
FIG. 2 is an enlarged, fragmentary side view of a drive shaft according to a second embodiment of the present invention, in which associated outer race and rolling members are omitted.

Reference is next had to FIG. 2 which illustrates the drive shaft according to the second embodiment of the present invention. As opposed to the provision of the inclined surface portion 13 between the curved surface portion 14 and the chamfered portion 9 in the first embodiment described above, the inclined surface portion 13 is omitted in the second embodiment so that the curved surface portion 14 and the chamfered portion 9 are directly and continuously connected together. The remaining construction and the advantage are similar to those of the first embodiment described above.

Figure 3:
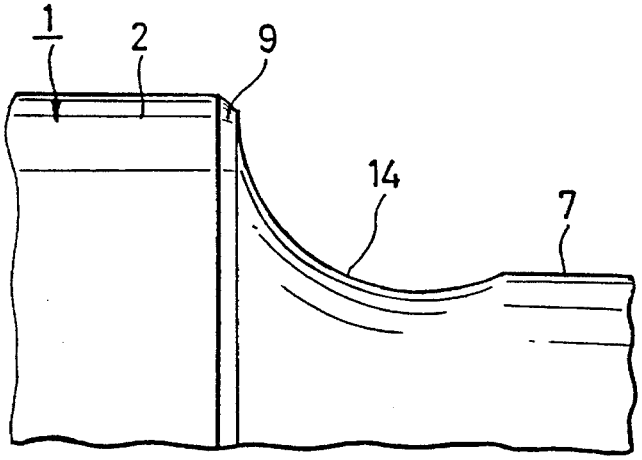
FIG. 3 is an enlarged, fragmentary side view of an illustrative drive shaft member of a profile which falls outside the technical scope of the present invention.
Figure 4:
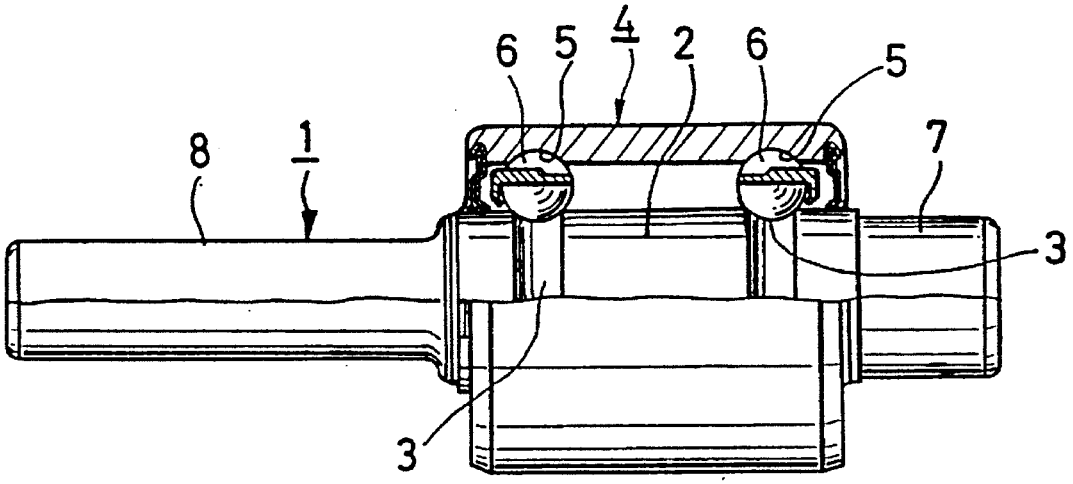
FIG. 4 is a side view of a bearing unit with a drive shaft member, to which the present invention can be applied, assembled therein, in which a quarter of the bearing unit has been cut off to show the internal structure.
Figure 5:
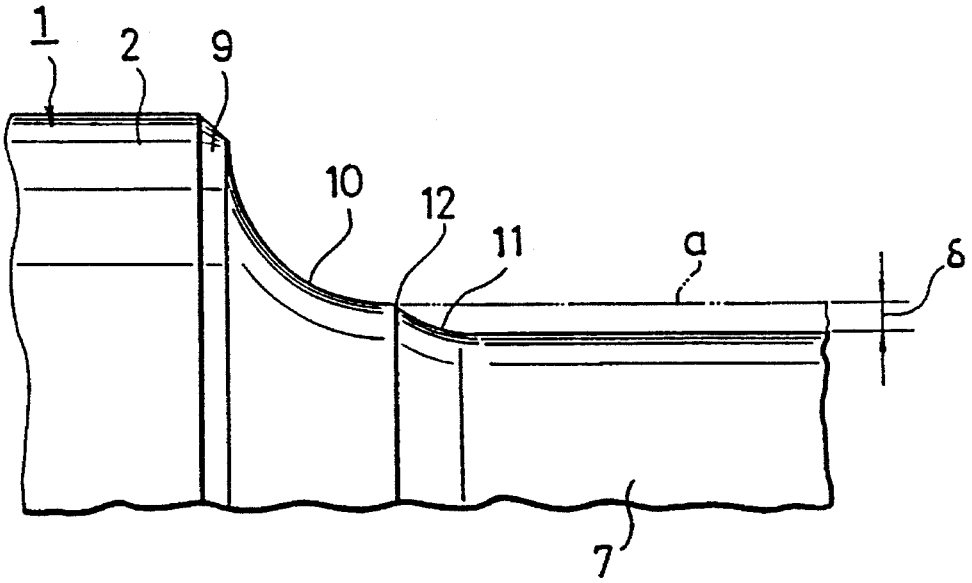
FIG. 5 PRIOR ART
FIG. 5 is an enlarged, fragmentary side view of a conventional drive shaft member.

In the drive shaft depicted in FIG. 3, the outer peripheral surface of the curved surface portion 14 is partly recessed relative to the outer peripheral surface of the small-diameter pulley shaft portion 7. A drive shaft of such a profile has greater strength than the conventional drive shaft illustrated in FIG. 5 but its bending strength has been reduced by as much as the reduction in diameter at the recessed part. The profile shown in FIG. 3 is therefore not fully preferred.

Incidentally, when the curved-surface limit space L (see FIG. 2) is the same, the present invention becomes more effective as the ratio (d/D) of the diameter d of the small-diameter pulley shaft portion to the diameter D of the large-diameter bearing portion increases, in other words, the difference in diameter between the small-diameter pulley shaft portion and the large-diameter bearing portion becomes greater. At d/D ≧0.88, for example, even the conventional profile shown in FIG. 5 does not develop any particular problem provided that the radius of curvature of each portion is properly chosen. At d/D ≦0.75, on the other hand, the conventional profile involves the potential danger that the drive shaft may be broken.

What is claimed is:

1. In a drive shaft for an automotive vehicle water pump, said drive shaft having an outer race with plural outer raceways formed in an inner peripheral wall thereof, a shaft member disposed for rotation relative to the outer race and defining a like plural number of inner raceways formed in an outer peripheral wall of the shaft member in radial registration with the corresponding outer raceways, and a multiplicity of rolling elements arranged between the inner raceways and the corresponding outer raceways, respectively, the improvement wherein said shaft member comprises:

a large-diameter bearing portion with the plural inner raceways formed in an outer peripheral wall thereof;

a small-diameter impeller shaft portion extending from one end of the large-diameter bearing portion;

a small-diameter pulley shaft portion; and a continuously-connecting portion extending between an opposite end of the large-diameter bearing portion and a proximal end of the small-diameter pulley shaft portion, said continuously-connecting portion presenting a curved peripheral surface with circular arcs in tangential directions of which an outer peripheral wall of the small-diameter pulley portion extends;

wherein the ratio (d/D) of the diameter (d) of the small-diameter pulley shaft portion to the diameter (D) of the large-diameter bearing portion is less than 0.88.

2. The drive shaft of claim 1, wherein the large-diameter bearing portion has a chamfered peripheral edge portion at the opposite end thereof.

3. The drive shaft of claim 2, wherein the continuously-connecting portion has an inclined surface portion continuously disposed between the chamfered peripheral edge portion and the curved peripheral surface.

* * * * *